US006871480B1

(12) United States Patent
Goodrich

(10) Patent No.: US 6,871,480 B1
(45) Date of Patent: Mar. 29, 2005

(54) PLEATED PAPER AND METHOD OF MANUFACTURING

(76) Inventor: David P. Goodrich, 14 Ox Hill Rd., Newtown, CT (US) 06470

( * ) Notice: Subject to any disclaimer, the term of this patent is extended or adjusted under 35 U.S.C. 154(b) by 743 days.

(21) Appl. No.: 09/163,042

(22) Filed: Sep. 29, 1998

Related U.S. Application Data

(60) Provisional application No. 60/068,570, filed on Dec. 23, 1997, and provisional application No. 60/060,255, filed on Sep. 29, 1997.

(51) Int. Cl.[7] ..... B65B 11/00

(52) U.S. Cl. ..... 53/461; 53/49; 53/140; 156/207; 156/210; 428/181; 493/463; 493/967

(58) Field of Search ..... 53/49, 449, 461, 53/472, 139.5, 140, 156, 157, 397, 465; 493/966, 967, 463, 433, 435; 156/205, 207, 210; 206/819; 229/87.02, 90, 939; 428/181

(56) References Cited

U.S. PATENT DOCUMENTS

| | | | | | |
|---|---|---|---|---|---|
| 707,183 | A | * | 8/1902 | Thiebaut | 229/90 |
| 1,470,200 | A | * | 10/1923 | Snyder | 206/814 |
| 1,940,596 | A | * | 12/1933 | Koppelman | 229/87.02 |
| 2,624,989 | A | * | 1/1953 | White | 53/449 |
| 3,235,432 | A | * | 2/1966 | George | 229/939 |
| 3,660,958 | A | * | 5/1972 | Garrison | 53/449 |
| 3,730,803 | A | * | 5/1973 | Morrison | 493/463 |
| 3,951,730 | A | | 4/1976 | Wennberg et al. | 428/116 |
| 4,507,348 | A | * | 3/1985 | Nagata et al. | 229/939 |
| 5,419,796 | A | * | 5/1995 | Miller | 493/463 |
| 5,558,923 | A | * | 9/1996 | Vesamaa | 493/967 |
| 5,593,755 | A | | 1/1997 | Fuss | 428/134 |

FOREIGN PATENT DOCUMENTS

| | | | |
|---|---|---|---|
| WO | 96/24540 | * | 8/1996 |

* cited by examiner

*Primary Examiner*—Stephen F. Gerrity
(74) *Attorney, Agent, or Firm*—Jagtiani + Guttag

(57) ABSTRACT

A novel packaging wrap is used in cushioning a product for shipment and is formed from the combination of a layer of pleated sheet material, the pleated material being creased at the apices of each pleat, and a planar layer of sheet material which is adhered to, and preferably, adhesively bonded, to a pleated sheet of kraft paper. The pleated sheet material has a weight in the range from about 30 to 50 pounds and the planar sheet material is preferably tissue paper having a weight of less than about 20 pounds. The pleated sheet material preferably, has a pleat angle in the range from above 45 degrees to below 85 degrees, and most preferably the pleats have an angle of about 50 to 65 degrees. Preferably, the pleats have a height in the range from about 3 sixteenths of an inch to about one half inch, in terms of distance between top planar sheet and bottom planar sheet.

15 Claims, 4 Drawing Sheets

PLEATED PAPER AND METHOD OF MANUFACTURING

CROSS REFERENCE TO RELATED APPLICATIONS

This application is a continuation-in-part of patent applications, of David P. Goodrich, Ser. No. 60/060,255, filed Sep. 29, 1997 entitled Pleated Paper and the Manufacturing Method, and Ser. No. 60/068,570, filed Dec. 23, 1997 entitled Void Fill Packaging Material, the disclosures of which are incorporated herein by reference, as though recited in full.

BACKGROUND OF THE INVENTION

1. Field of the Invention

The instant invention encompasses a new packaging material and a new manufacturing method for producing the packaging material.

2. Brief Description of the Prior Art

Typically, the use of paper, plastics, foams, and wood represent the bulk of the materials used to provide blocking, bracing, cushioning, crating, boxing and void fill. The desire has become increasing great to produce cushioning products from paper, and various products are now found in the market. However, each of these product have various shortcomings, such as difficulty of manufacture or use.

SUMMARY OF THE INVENTION

The problems and shortcomings of the prior art packaging products, can be overcome through the use of a novel packaging wrap material. It can be used in cushioning a product for shipment and is form from the combination of a layer of pleated sheet material, the pleated material being creased at the apices of each pleat, and a planar layer of sheet material which is adhered to, and preferably, adhesively bonded, to the pleated material.

The pleated sheet material is a preferably a kraft paper having a weight in the range from about 30 to 50 pounds and the planar sheet material is preferably tissue paper having a weight of less than about 20 pounds. The pleated sheet material preferably, has a pleat angle in the range from above 45 degrees to below 85 degrees, and most preferably the pleats have an angle of about 50 to 65 degrees.

The method of packaging a product for shipping within the protective cushion wrap of the present invention includes the steps of unrolling sheet material from a continuous roll and forming a series of pleats in the sheet material the roll of sheet material having an axis and the direction of unrolling being transverse to the axis. The pleats have their apices parallel to the central axis of the continuous roll. At least one planar sheet from a continuous roll of sheet material is brought into contact with the pleated sheet material, and the pleated sheet material adhered to the sheet of planar from the continuous roll, preferably of tissue paper, to form the combination of a sheeted of pleated material and a cover sheet layer. A length of the combination of pleated material and a cover sheet are severed to form a composite packaging wrap material.

A product is completely enclosed within the packaging wrap material, with at least two end regions overlapping each other to form a region having at least two layers of packaging wrap material. The composite can then be conformed to the shape of the enclosed product.

Preferably, the pleats have a height in the range from about 3 sixteenths of an inch to about one half inch, in terms of distance between top planar sheet and bottom planar sheet.

The preferred pleated sheet material is a kraft paper having a weight in the range from about 50 pounds to below about 100 pounds, and the pleats have a height in the range from about one half inch to about one inch, use with applications requiring a high support rigid packaging material. Most preferably, the pleated material is a kraft paper having a weight in the range from about 50 pounds to below about 70 pounds, and the pleats have a height in the range from about three sixteenths of an inch to about one half inch, for use with the protective cushioning of fragile products. For the fragile applications, the preferred planar sheet has a weight of up to about 20 pounds and is a tissue paper. Most preferably, the tissue paper is in the weight range from about 10 to about 20 pounds. Most preferably the pleated sheet material is kraft paper, and is pleated by crushing fibers at the apices of the pleats.

The preferred method comprises crushing the paper fibers at the apices of the pleats, between a pair of mating gears, the mating gears having side wall angles in the range from about 60 degrees to about 85 degrees and most preferably in the range from about 65 to below 80 degrees. The roots of the gears having a preferred root dimension in the range from about 0.015 to 0.035 inches wide with a most preferred root dimension range of 0.015 to 0.025 inches. The crest, in order to sharply crease the paper, is in the range up to about 0.01 of an inch, and most preferably in the range from about 0.004 to 0.01, depending upon the paper thickness being creased, with a most preferred range of about 0.004 to 0.006 inches. The primary point is that the root must be wide enough to receive the crest without having the side walls of teeth forced against each other. Thus, the dimensions must provide for a space between mating teeth for the paper regions not being crushed and for crushing between the root and crest. That is, most preferably, there is no crushing between side walls and crushing between the crest and root to produce a well defined crease.

DESCRIPTION OF THE PREFERRED EMBODIMENTS OF THE INVENTION

Figure 3:
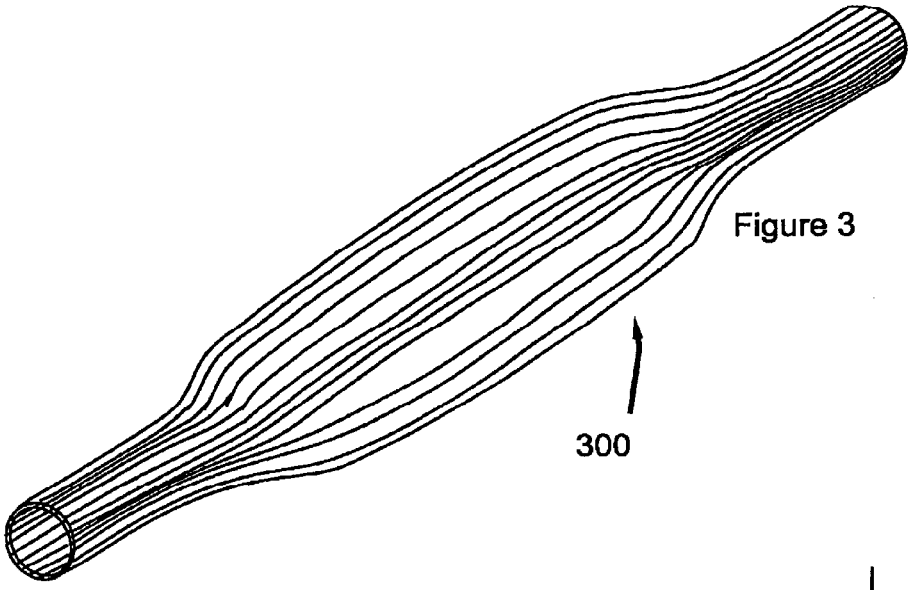
FIG. 3 is a perspective view of the cushioning material of the present invention wrapped around an article.

The new product design produces a unique product and a unique use of the product. Through the use of a combination of different types and weights of paper, the new product provides dramatic cushioning and structural products for the packaging industry. The structure of the present invention utilizes a modified pleat design which can accomplish all of these tasks with 100% recyclable paper, virgin paper, or a combination thereof.

The use of pleated papers has been primarily limited to the filter, lampshade, and garment industries. Nevertheless, the design of the packaging product is in the form of a pleated paper product. Specifically, in the preferred embodiment, it is a composite of a light weight inner layer of pleated paper, preferably of light weight kraft paper, between an inner and outer layer of an extremely light weight material, such as tissue paper. The performance characteristics of the composite structure can be selectively modified by varying (1) the pleat height or profile, (2) the pleat paper weight, (3) the top and bottom paper weight, and (4) the number of pleats per foot, which raises or rotates the pleat wall towards the vertical. As these walls become vertical the paper is less able to bend and the structure becomes more rigid. For absolute rigidity, chip board or corrugated pleats can be glued to either chip board or corrugated top and bottom layers can be used, while adding more pleats per foot to produce the highest amount of rigidity.

By way of contrast, the use of tissue paper, such as about 10 or 15 pound tissue, for the top and bottom layers and about 30 pound paper for the 3⁄16" profile pleating, provides a great deal of cushioning and flexibility as a wrapping material. It is also easy to fold up to be used as void-fill. The unique combination is resiliently rigid when subjected to compression, but is extremely flexible. The composite is virtually moldable around an object and can conform to the shape of an article.

It should be understood that corrugated fluted is a product which is a paper product formed by steam treatment and chemical impregnation, to form a rigid sinusoid wave. Structural rigidity is produced through the processing of the paper. Pleated paper achieves its structural strength through the geometry of the product. Attention is invited to U.S. Pat. No. 3,951,730 which is directed to a structure which is disclosed as being used as isolation or as packing material. The structure includes a bearing wall, which is consistent with the use in the prior art of vertical structural members. The instant invention relies on the non-vertical walls for structural strength and flexibility and is free of vertical retaining or bearing walls. Rather than using a vertical bearing wall, it has now been found that it is advantageous to not only having a system which is entirely or substantially entirely free of vertical walls, but also which goes to the other extreme by using an unusual combination of light weight papers.

Particularly for void fill, the 3⁄16" profile is preferred in combination with the about 10 pound tissue and about 30 pound kraft paper, and provides a low cost usage than is attainable with a comparable plastic air bubble package material. This is in part due to the greater amount of air trapped during the folding and manipulation of the product and manufacturing cost advantages. Air bubble or air cap cushioning, due to its extreme flexibility, tends to fill the voids completely. The pleat material is very flexible in the transverse direction of the pleats, but more rigid along the pleat creases providing stacking support. The pleated cushioning product leaves greater amounts of void space than air bubble cushioning material, and thus is more effective as a void fill. In this instance, inefficiency is better than high efficiency. The structural integrity of the pleated structure is produced by the geometry of the product, and thus, it has been found that light weight paper can be used to produce a unique cushioning product, having properties which are dissimilar to corrugated products.

Figure 1:
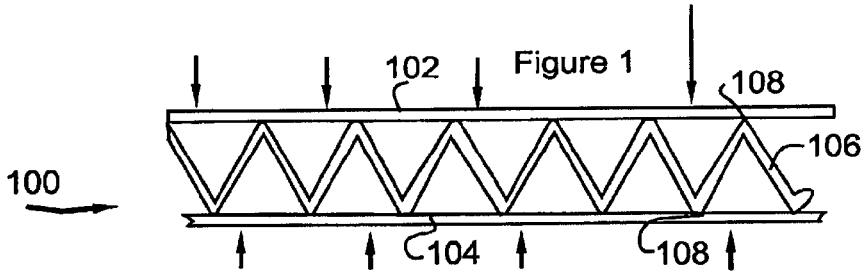
FIG. 1 is an end view of a cushioning material in accordance with the present invention.
Figure 2:
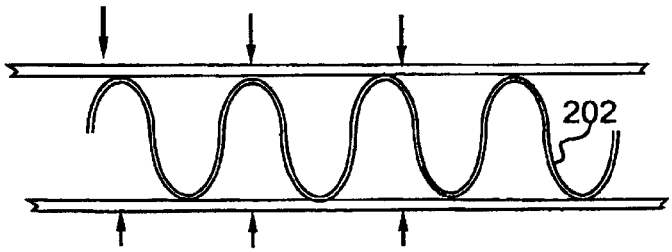
Prior Art Figure 2
FIG. 2 is and end view of corrugated material of the prior art.

The new cushion material indicated generally as 100, as shown in FIG. 1, is a combination of two outer layers of paper 102 and 104, enclosing one layer of pleated material 106. The pleated material is bonded to the top and bottom of each of the ridge lines or apices 108. The side walls 106 must be non-vertical and are preferably less than 85 degrees, with a preferred angle as formed being about 60, since the angle increases when the product is relaxed prior to gluing. This product is contrasted with the prior art corrugated product 200, illustrated in FIG. 2, and shown to have fluting 202. The ability of the product 300, to conform to the shape of a product, such as a wine bottle, or glass vase, or the like, is illustrated in FIG. 3.

Figure 4A:
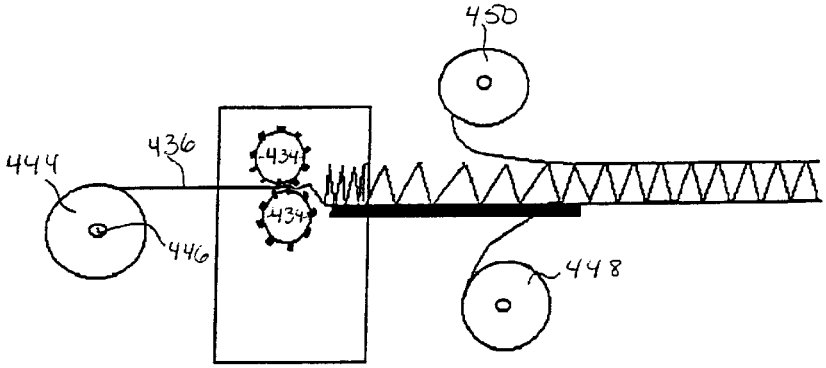
FIG. 4*a* is a schematic illustration of the pleating equipment of FIG. 4, and further showing the application of the top and bottom sheets which are being adhesively bonded to the pleated sheet.
Figure 4:
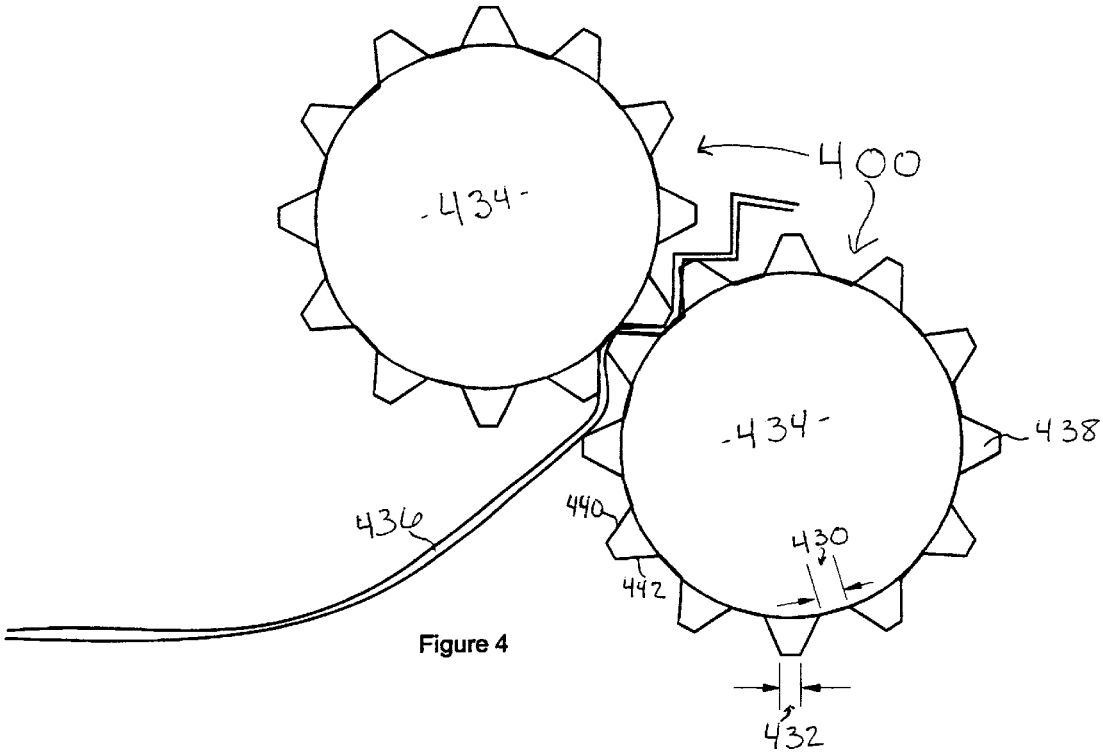
FIG. 4 is an end view of a pleating operation employed a pair of intermeshing gears.
Figure 5:
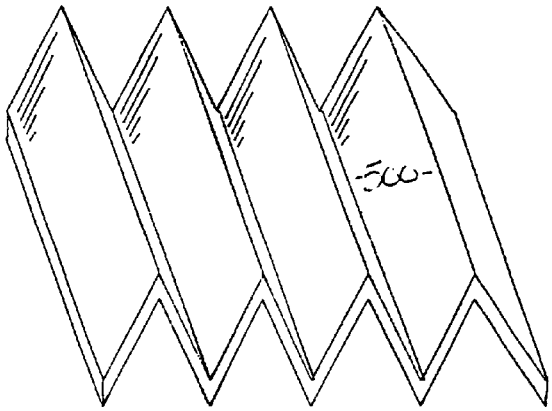
FIG. 5 is a perspective view of pleated sheet material.
Figure 7:
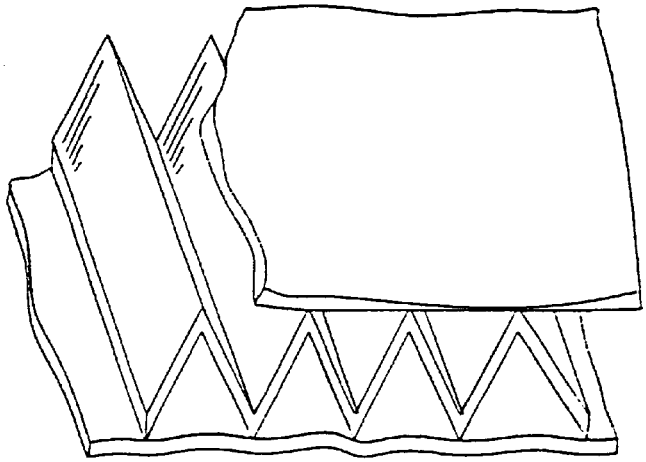
FIG. 7 is a perspective view of the pleated sheet material of FIG. 5, with a top and bottom layer of tissue paper.

A preferred pleating apparatus is illustrated in FIG. 4, and indicated generally as 400. The process of manufacturing pleats has not been applied to create a packaging product either as just a pleat in sheet form, as shown in FIG. 5, or as a combination of pleating glued to top and bottom layers of paper as shown in FIGS. 1 and 7.

The manufacturing process is unlike that which is employed for producing corrugated paper products. The process for producing corrugated products, as shown in FIG. 3, produces rounded inner fluting 202, providing almost vertical walls and a large gluing surface area for rigidity. The fluting height, or profile, is very small to provide the maximum amount of rigidity. The strength of a corrugated box is its ability to remain in shape, without stretching or tearing and is structurally rigid, even in the absence of a planar layer, as in single or double faced corrugated. It is the opposite of cushioning. Pleating can produce varying levels of structural rigidity, but has the ability to increase the profile well beyond corrugated's of 1⁄8–1⁄4 inches to a rigid pleat height of 2 inches or more, less expensively.

As the need for thicker walls of a rigid packaging material increased, the corrugated industry went from single to double to triple wall corrugated. The reason for this is that larger corrugated fluting, without the rigidity capability of creased or pleated paper, becomes progressively weaker and collapses easily. Honeycomb was introduced to provide a less expensive, but extremely rigid, material when larger profiles were needed. Pleating can provide the equivalent rigidity as corrugated or honeycomb, but without the multiple layers of paper and glue in corrugated and the slow manufacturing process as compared to honeycomb, providing an equivalent product more cheaply. From FIG. 2, it can be seen that variations in pleat angle can be attained by varying the number of pleats per foot. In this way, the varied degrees of stiffness can be obtained utilizing the same paper weights. In addition, a cushioning factor can be built in, due to the ability to vary the pleat angle. The flexibility that honeycomb and corrugated can not provide, is provided by the pleated sheet material. This is due in part to the tissue paper having virtual no structural strength other than tensile strength, and the pleat having significant structural strength only in compression at a right angle to the main plane of the pleated sheet. The term "main plane", as used herein, refers to the plane of the sheet in unpleated form, which is also the plane of the planar top or bottom layer 120 or 122.

The pleats are formed with their center line at a right angle with respect to the plane of the paper. The walls of the pleat have a substantially less than 90 degree included angle at their apex. Whereas the walls of a corrugated sheet can be essentially vertical, and honeycombs are vertical walled structures, the pleated material must be a substantially lesser angle.

The pleat sheet material 436 is on a continuous roll having a central axis 446. The material passes between the matched gear teeth 438, of the gears 434. The angle of the side walls 440 and 442 is not narrowly critical. The gear teeth have a crest 432 and a root area 430, for receiving the crest of the mating gear.

Another inventive aspect of the product is the use of the pleated paper in continuous sheets as in FIG. 5 with the use of pleating 500 alone. Pleating by itself adds rigidity to paper and provides an inexpensive and easy to use void fill product as an alternative to Styrofoam peanuts. The pleat is quick to use, dust free, and inherently maintains its shape through the shipping process. Unlike other paper products, which rely on random crumpling of the paper, which creates haphazard creasing, pleating exploits the paper to its highest volume with the best rigidity in a consistent pattern that can standardize the packaging integrity giving more stable results. The creasing of the paper adds the rigidity and air volume to the paper to create a light weight void fill alternative. In contrast in the present market, Padpak, a prior art product, forces air between three layers of paper by folding the layers together. The resulting product is bulky to begin with, but soon crushes due to the roundness, in contrast, to creasing (pleating) process. Ecopack is a prior art invention which is used in ⅛" creased strips to create a better process to permanently entangle thin strips of paper. The new product, in contrast to Ecopack adds stacking strength by deliberately using wide sheets, on or about 6 inches in ridge line width and preferably at least about 12 inches or more, that resist folding parallel to the pleat ridges lines. This stiffness creates a memory that produces a more durable void fill product. The product of the present invention is also much easier to discard than Ecopack, as it is used to wrap a product with one sheet rather than in tiny strips of paper.

An additional approach to void fill is the use of the pleated paper only with glue beads bisecting the pleat direction so that a pleated paper obtains a stiffness every two or three intervals, or the intervals that the customer would desire. Like the pleating that creates stiffness in the direction of the pleats, the glue bead, being a continuous stream of glue, provides stiffness by traveling up and down the hills and valleys of the pleating. This bead of glue has been used to maintain the shape of paper filters that, under extreme pressure, from the liquids passing through the paper and creating a pressure differential, maintains the filter shape.

A prior art invention, sold under the trademark Geoami, is another paper product that is used as a cushioning material for fragile items. Geoami is made of slit paper stretched to form hexagons from rotated ¼" portions of paper. These hexagons form rigid low profile roughly 58 degree angled cells. The pleated paper reaps the same benefit as these angled cells, but without the dust created from the die cutting of the Geoami product. In addition, Geoami only becomes thicker with multiple wrapping since the distance between the slits is critical for Geoami to work. This inability to change the profile from 3⁄16", when rotated to its fullest, becomes inefficient, labor intensive, and utilizes more paper as a result. In contrast, the new art can be fine tuned to provide the optimum usage of paper, at the required thickness, and with the required rigidity.

Pleating provides these different cushioning and structural qualities by varying the paper weight, pleat profile, and pleats per foot, to generate a family of products to provide one stop recyclable packaging design and application. As is now obvious to the reader, varying the pleated paper weight and pleats per foot produces varying stiffness. In addition, the paper weight of the top and bottom layers change the cushioning or structural strength of the new art, that is, the technology of the present invention. Thickening the top and bottom layers spreads the load more evenly, between the pleat ridges, and inhibits flexing between the pleats, thereby producing an even stronger product.

An additional aspect concerning the pleat profile is the ability of the pleat legs to flex. A thinner material will flex more easily than a thicker, heavier weight material. Therefor a requirement for a taller, but soft packaging material can be met by utilizing the same paper weight used in a smaller pleat profile designed for rigidity. In contrast, a very inexpensive cushioning design would use a light weight paper pleat with a short pleat profile. This serves to produce an excellent cushioning and inexpensive packaging product for the most light weight and fragile items.

In order to produce a wrapping material that would be not only flexible, but able to mold around an object to be packaged and remain permanently shaped so that no taping or fastening is required, the use of light weight pleating paper, namely on or about 30# paper weight (30 lbs/3000 sq.ft), at a 3⁄16" pleat height, glued top and bottom to 10# tissue (10 lbs./2880 sq.ft) can be used. This combination, surprisingly, offers excellent cushioning protection. What is very noticeable is that as the top and bottom sheets become lighter in weight the overall utility of the product, for protective packaging, remains the same. The difference lies in the ease of use. For void-fill there is a desire for stiffness, thus heavier outer paper can be used to accomplish this desired result.

For wrapping, as in this example, the tissue provides great flexibility, enhancing ease of use, moldability into permanent shapes around the object, with the equivalent cushioning. The 3⁄16" pleat height also enhances the ability for the user to wrap with ease, in multiple windings, to accumulate protective layers. This concept is typically used with a plastic air bubble type of wrap. Plastic air Bubble packaging wrap provides its best protection using the smaller profile (3⁄16") bubble providing more bubbles per inch. Surprisingly, the 3⁄16" pleat provides optimum protection by providing optimum pleats per inch, and pleated peaks to make contact in the same amount of surface area. Thus, while the mechanisms of operation are different, the optimum heights for air bubble wrap and the pleated wrap are similar, for high cushioning applications.

The tissue, in essence, becomes merely the glue for the system to work. Without the tissue, it would be easy for the pleated paper to collapse, that is, to flatten under load. With the tissue glued to the pleated sheet, the composite structure maintains its shape, but uniquely remains flexible. Tissue paper, inherently is a very weak product, but in this instance it provides integrity to the material with the only strength it has, namely, tensile-strength. The tensile strength of 10# tissue, rated using a ⅝" strip of paper is 2½ to 3 lbs in strength. 15# tissue varies from 5½ lbs. to 6½ lbs. Therefore, it is the tissue tensile strength that provides this "glue". The lighter the paper weight the greater the square feet per roll the cheaper the paper becomes on a per square foot basis. The optimum design, for wrapping, would then be an infinitely thin material providing enough tensile strength to maintain its shape. As the paper gets lighter it also becomes progressively less expensive and more flexible.

Figure 8:
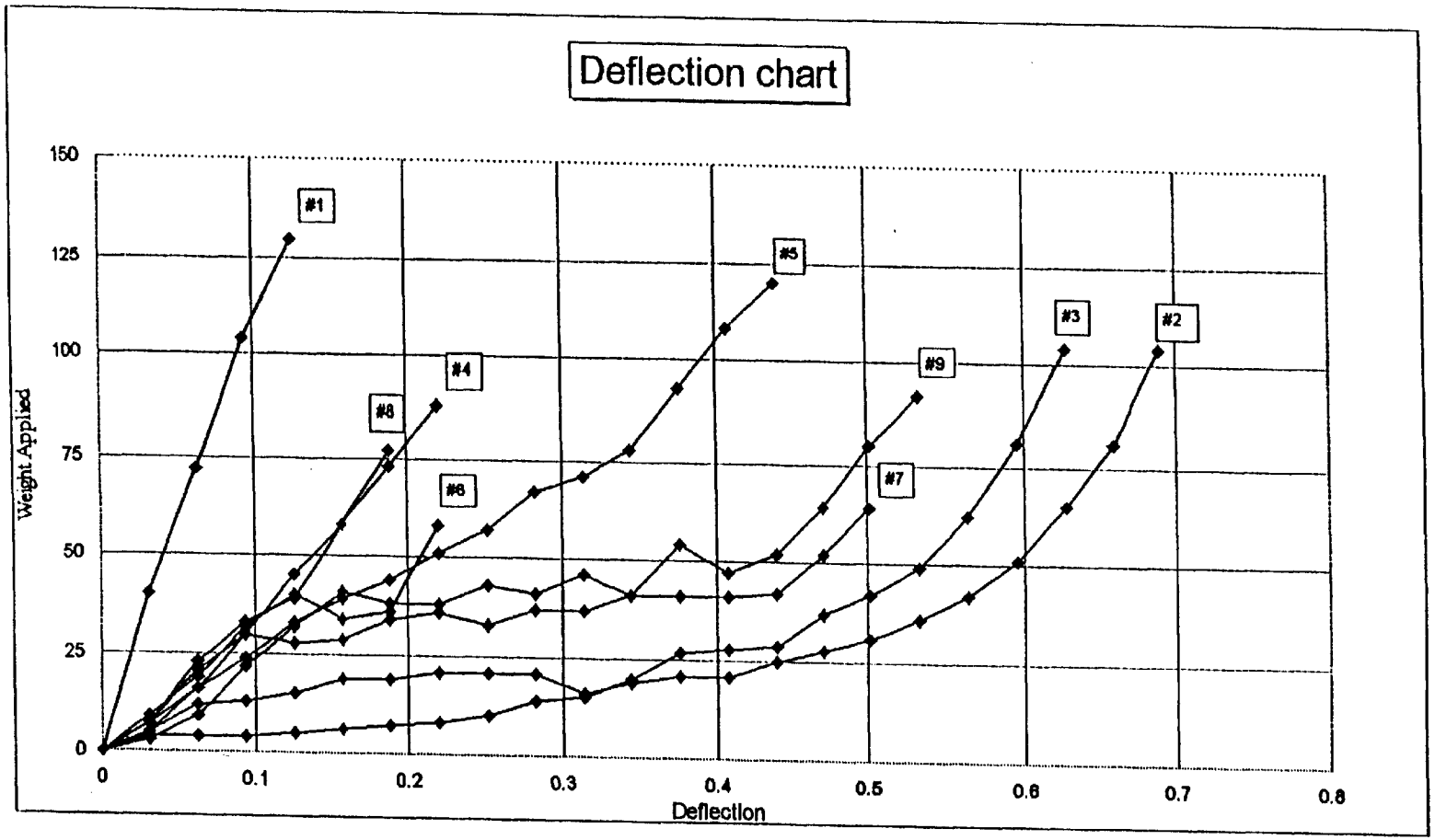
FIG. 8 is a deflection chart comparing deflection curves for a variety of products.

The graph of FIG. 8, depicts the crushing strength of 3⁄16" paper utilizing 30# pleated paper and 10# tissue paper. The tissue paper can be analogized to the cables on a bridge. Bridge cables have great tensile strength, and add rigidity through interaction with the other bridge components, though, on their own, cables have little structural rigidity.

The Geoami brand of expanded sheet material and air bubble packaging wrap, have no analogous component. In corrugated board, the corrugated fluting is essentially rigid and self-supporting as a-result of the manufacturing process which produces the fluting. The top and bottom sheet prevent nesting of layers, but do not have the significant or corollary function of tissue in the present invention.

The pleating process only produces a series of parallel, uninterrupted creases, and does not adversely effect the properties of the sheet material. Whereas corrugated fluting, by itself, is normally extremely rigid under compression, pleated sheets can merely collapse under compression, unless locked in place. The tissue paper, like bridge cables, interacts with the angled walls of the pleats, to form an engineering material. It is for this reason, that tissue paper can work as a structural material in combination with a sheet of pleated kraft paper.

The combination of paper weights which is preferably used, is surprisingly low. In the pleated structure, the structural pleated layer is about thirty pound kraft paper with the outer layer or layers, being about ten or fifteen pound tissue paper. This is due to the use of a pair of equally angles side walls. In corrugated sheeting, the fluting is much heavier and thicker, representing the other end of the weight spectrum. The slit pattern of the Geoami brand material determines the maximum expansion of the product. By way of contrast, the pleated material employs a glued, light weight layer, to maintain the product in the desire, maximum expansion configuration. The width of pleated paper and the top and/or bottom sheets, is preferably, at least about 12 inches wide. Unlike a product, such as disclosed in U.S. Pat. No. 5,593,755, the instant invention uses an uninterrupted pleat for optimum performance. Widths of uninterrupted pleated sheets can be of any desired lengths, and widths of up to about four feet can be employed. Width of under 12 inches of continuous, that is, uninterrupted pleats, are preferred.

In the present invention, the preferred range for the weight of Kraft paper is from about 30 to 50 pounds. By way of contrast, the range for Geoami brand of cushion materials, Kraft paper would be in the 50 to 80 pound range, and for corrugate sheeting, the range is 70 pounds and up. As the paper weight is increased in the pleated cushioning design of the present invention, the ability of the finished product to mold to the shape of a wrapped product decreased. Thus, while a chip board material can be used to produce a pleated product, it would have totally different performance characteristics from the 30 to 50 pound range pleated product and would not be moldable, that is, would not contour to the shape of the contained product.

In the pleated structure, the structural pleated layer is about thirty pound Kraft paper with the outer layer or layers, being ten pound tissue paper. In corrugated sheeting, the fluting is much heavier and thicker, representing the other end of the weight spectrum.

Eight pleating products were manufactured for testing.

Curve 1 represents the base line for the test with the test apparatus run without test material.

Tests 1 to 8 correspond to curves 2 through 9.

The first test, is a pleat utilizing 100# paper. The second, is a pleat utilizing about a 70# paper. Both products utilize the same top and bottom layer weights of about 60# paper. Both tests used, ⅝" or 0.625" pleat profiles. Adding the top and bottom layers creates a total thickness of 0.639". Pleating, on average for both products, had ¾" pleat spacing (16 pleats per foot). Tests 3 through 8 (curves 4 through 9) utilized 30# pleat paper, at the 1/16" (0.1875") profile, with varying weights of top and bottom layers. Additionally, curves 5, 7, and 9 represent the use of three plies of material to reveal differences in multiple layers usage. Test represented by curves 8 and 9 were just the pleating itself.

Figure 6:
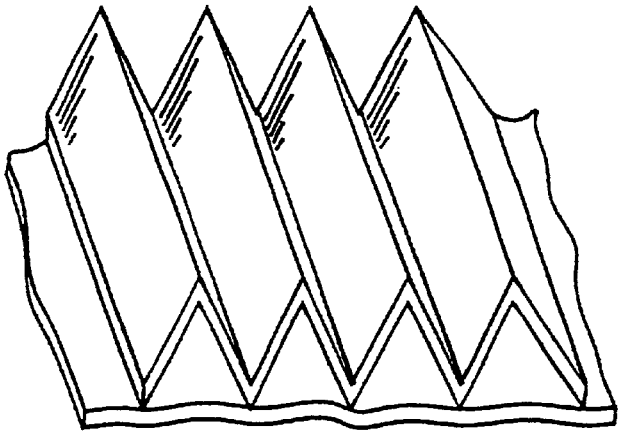
FIG. 6 is a perspective view of the pleated sheet material of FIG. 5, with a single layer of tissue paper.

These tests were performed to demonstrate the variations in strength by modifying the paper weights. FIGS. 5, 6 and 7 show the different pleated designs used. The test applies a downward crushing force, or deflection, on the products being tested, in 0.031" increments, and records the resulting weight needed to produce the deflection. FIG. 7 displays the test results on a graph to compare the data.

The first curve represent the Machine Empty, and "zeroes", the testing apparatus, that is, it establishes the base line or zero line, for the test. The control arm of the apparatus flexes under tension and this flexing is recognized as a phantom deflection. The angle of the machine ONLY deflection, curve 1, should be taken into account only for the purposes of revealing that all tested material would actually be slightly steeper in curve and when the curve is as steep at the machine itself that the material is fully crushed.

CHART I

| Product | Weight Applied | X Axis Zeroed Weight | Position | Total Deflection |
|---|---|---|---|---|
| TEST 1 | Machine Empty | | | |
| | 0 | 0 | 0 | 0 |
| | 40 | 40 | 1 | 0.03135 |
| | 72 | 72 | 2 | 0.0627 |
| | 104 | 104 | 3 | 0.09405 |
| | 130 | 130 | 4 | 0.1254 |
| TEST 2 | 5/8" 100# Pleat Total thickness .639 | | | |
| | −2 | 0 | 0 | 0 |
| | 3 | 5 | 1 | 0.03135 |
| | 10 | 12 | 2 | 0.0627 |
| | 11 | 13 | 3 | 0.09405 |
| | 13 | 15 | 4 | 0.1254 |
| | 17 | 19 | 5 | 0.15675 |
| | 17 | 19 | 6 | 0.1881 |
| | 19 | 21 | 7 | 0.21945 |
| | 19 | 21 | 8 | 0.2508 |
| | 19 | 21 | 9 | 0.28215 |
| | 14 | 16 | 10 | 0.3135 |
| | 17 | 19 | 11 | 0.34485 |
| | 19 | 21 | 12 | 0.3762 |
| | 19 | 21 | 13 | 0.40755 |
| | 23 | 25 | 14 | 0.4389 |
| | 26 | 28 | 15 | 0.47025 |
| | 29 | 31 | 16 | 0.5016 |
| | 34 | 36 | 17 | 0.53295 |
| | 40 | 42 | 18 | 0.5643 |
| | 49 | 51 | 19 | 0.59565 |
| | 63 | 66 | 20 | 0.627 |
| | 79 | 81 | 21 | 0.65835 |
| | 102 | 104 | 22 | 0.6897 |
| TEST 3 | 5/8" 70# Pleat Total thickness .639" | | | |
| | −4 | 0 | 0 | 0 |
| | 0 | 4 | 1 | 0.03135 |
| | 0 | 4 | 2 | 0.0627 |
| | 0 | 4 | 3 | 0.09405 |
| | 1 | 5 | 4 | 0.1254 |
| | 2 | 6 | 5 | 0.15675 |
| | 3 | 7 | 6 | 0.1881 |
| | 4 | 8 | 7 | 0.21945 |
| | 6 | 10 | 8 | 0.2508 |
| | 10 | 14 | 9 | 0.28215 |
| | 11 | 15 | 10 | 0.3135 |
| | 16 | 20 | 11 | 0.34485 |
| | 23 | 27 | 12 | 0.3762 |

-continued

CHART I

| Product | Weight Applied | X Axis Zeroed Weight | Position | Total Deflection |
|---|---|---|---|---|
| | 24 | 28 | 13 | 0.40755 |
| | 25 | 29 | 14 | 0.4389 |
| | 33 | 37 | 15 | 0.47025 |
| | 38 | 42 | 16 | 0.5016 |
| | 45 | 49 | 17 | 0.53295 |
| | 58 | 62 | 18 | 0.5643 |
| | 77 | 81 | 19 | 0.59565 |
| | 100 | 104 | 20 | 0.627 |
| TEST 4 | 3/16" .1 ply. 30# Pleat. 15# tissue Total thickness .1875" | | | |
| | −3 | 0 | 0 | 0 |
| | 2 | 5 | 1 | 0.03135 |
| | 13 | 16 | 2 | 0.0627 |
| | 27 | 30 | 3 | 0.09405 |
| | 42 | 45 | 4 | 0.01254 |
| | 55 | 58 | 5 | 0.15675 |
| | 70 | 73 | 6 | 0.1881 |
| | 85 | 88 | 7 | 0.21945 |
| TEST 5 | 3/16" × 3 layers 30# Pleat. 15# tissue Total thickness .5625" | | | |
| | −3 | 0 | 0 | 0 |
| | 4 | 7 | 1 | 0.03135 |
| | 13 | 16 | 2 | 0.0627 |
| | 21 | 24 | 3 | 0.09405 |
| | 30 | 33 | 4 | 0.1254 |
| | 36 | 39 | 5 | 0.15675 |
| | 41 | 44 | 6 | 0.1881 |
| | 48 | 51 | 7 | 0.21945 |
| | 54 | 57 | 8 | 0.2508 |
| | 64 | 67 | 9 | 0.28215 |
| | 68 | 71 | 10 | 0.3135 |
| | 75 | 78 | 11 | 0.34485 |
| | 90 | 93 | 12 | 0.3762 |
| | 105 | 108 | 13 | 0.40755 |
| | 117 | 120 | 14 | 0.4389 |
| TEST 6 | 3/16" × 1 layer 30# Pleat. 10# tissue Total thickness .5625" | | | |
| | −2 | 0 | 0 | 0 |
| | 7 | 9 | 1 | 0.03135 |
| | 17 | 19 | 2 | 0.0627 |
| | 30 | 32 | 3 | 0.09405 |
| | 38 | 40 | 4 | 0.1254 |
| | 32 | 34 | 5 | 0.15675 |
| | 34 | 36 | 6 | 0.1881 |
| | 56 | 58 | 7 | 0.21945 |
| TEST 7 | 3/16" × 3 layers 30# Pleat. 10# tissue Total thickness .5625" | | | |
| | −3 | 0 | 0 | 0 |
| | 0 | 3 | 1 | 0.03135 |
| | 6 | 9 | 2 | 0.0627 |
| | 19 | 22 | 3 | 0.09405 |
| | 29 | 32 | 4 | 0.1254 |
| | 38 | 41 | 5 | 0.15675 |
| | 35 | 38 | 6 | 0.1881 |
| | 35 | 38 | 7 | 0.21945 |
| | 40 | 43 | 8 | 0.2508 |
| | 38 | 41 | 9 | 0.28215 |
| | 43 | 46 | 10 | 0.3135 |
| | 38 | 41 | 11 | 0.34485 |
| | 38 | 41 | 12 | 0.3762 |
| | 38 | 41 | 13 | 0.40755 |
| | 39 | 42 | 14 | 0.4389 |
| | 49 | 52 | 15 | 0.47025 |
| | 61 | 64 | 16 | 0.5016 |
| TEST 8 | 3/16" × 1 layer 30# Pleat. ONLY Total thickness .5625" | | | |
| | 0 | 0 | 0 | 0 |
| | 7 | 7 | 1 | 0.03135 |
| | 23 | 23 | 2 | 0.0627 |
| | 33 | 33 | 3 | 0.09405 |

-continued

CHART I

| Product | Weight Applied | X Axis Zeroed Weight | Position | Total Deflection |
|---|---|---|---|---|
| | 39 | 39 | 4 | 0.1254 |
| | 58 | 58 | 5 | 0.15675 |
| | 77 | 77 | 6 | 0.1881 |
| TEST 9 | 3/16" × 3 layers 30# Pleat. ONLY Total thickness .5625" | | | |
| | −3 | 0 | 0 | 0 |
| | 4 | 7 | 1 | 0.03135 |
| | 18 | 21 | 2 | 0.0627 |
| | 27 | 30 | 3 | 0.09405 |
| | 25 | 28 | 4 | 0.1254 |
| | 26 | 29 | 5 | 0.15675 |
| | 31 | 34 | 6 | 0.1881 |
| | 33 | 36 | 7 | 0.21945 |
| | 30 | 33 | 8 | 0.2508 |
| | 34 | 37 | 9 | 0.28215 |
| | 34 | 37 | 10 | 0.3135 |
| | 38 | 41 | 11 | 0.34485 |
| | 51 | 54 | 12 | 0.3762 |
| | 44 | 47 | 13 | 0.40755 |
| | 49 | 52 | 14 | 0.4389 |
| | 61 | 64 | 15 | 0.47025 |
| | 77 | 80 | 16 | 0.5016 |
| | 89 | 92 | 17 | 0.53295 |

The first column of Chart I, shows the weight pleated material numerical data, and the second column shows the weight recorded for each ¼ turn (0.031" movement) of downward travel. The third column "zeroes" the weight to "0" pounds for actual force applied. The fourth column shoes the position in ¼ turn increasing increments. The fifth column converts the position into actual total deflection by multiplying the position by 0.031". As one can see the two materials are flattened at 0.64 inches deflection since they are 0.639" in thickness.

The graph, of FIG. 8, dramatically shows the ability to create varying cushioning protection utilizing different paper weights. As the paper pleat weight is increased, all else being equal, the structure of the present invention supported more weight through the crushing process, thus proving that a family of products can be created utilizing the technology of the present invention. As the tests were performed using lighter weight paper, for the 3/16" profile, a greater force is needed to deflect the product. This is due to the greater number of pleats per foot. Even though the paper weight has dramatically been reduced, the increase in pleats per foot make the product much stronger. This combination provides the optimum usage for paper since the yield per ton of material used goes way down with the use of lighter weights.

The slit pattern of the Geoami brand material determines the maximum expansion of the product. By way of contrast, the pleated material employs a glued, light weight layer, to maintain the product in the desire, maximum expansion configuration.

In general, as pleat profile increases, so does the packaging speed. This is especially true for the void-fill market. A taller pleat profile adds volume, to the package, more quickly than a short pleat profile. From our testing it is evident that the pleat height on or about ½" to 1" with a paper weight on or about 70 pounds for the pleat layer with 16 to 30 pleats per foot, and 30 to 70 pounds for the top and bottom layer to provide the best flexibility and resiliency for a void fill product.

From the testing it is evident that for best cushioning protection, a pleat profile on or about ⅜" with 30 to 70 pound pleated paper weight and a top and bottom layer from tissue weight to on or about 30 pound paper with 16 to 30 pleats per foot, provides the best cushioning protection for fragile items like crystal and other glassware. We have found that 10# to 15# tissue utilizing 30#–40# paper to be ideal for very fragile items like crystal. The preferred combination is a range of about 10 to 20 pound tissue and a range of about 30 to 50 pound kraft glued to at one sheet, and most preferably both a top and bottom sheet. This combination is preferably used with uninterrupted pleats of at least 12 inches in width and most preferably, with about 16 to 30 pleats per foot. The pleat height, that is distance between the top and bottom sheets, is preferably at least about ⅜ths of an inch. A preferred upper limit is about one half an inch for a soft cushioning product. A pleat height in the range from about one half to one inch, and most preferably about ¾ to about one inch, provides a low cost void fill material and would be used with a heavier weight pleated paper, in the range from about 50 to 70 pound kraft paper. It should also be noted, that where the product is to be used for an envelope, the outer layer can be a high strength material such as the product sold under the trademark Tyvek.

From the testing it is also evident that for best structural rigidity for crating and boxing, a ¾" up to a 4" layer pleat material consisting of 10 pt chipboard material to on or about a 200 weight corrugated material with a top and bottom layer equivalent in approximate weight to the pleated material. It should be noted that this type of product has performance characteristics which are dramatically different from that of the 30 to 50 pound kraft combined with tissue paper.

The characteristics and performance of the pleated product is related to the fold angle of the product. The range can be 45 to 80 degrees, with about 55 to 65 being preferred and providing optimum cushioning performance characteristics and volume to material ratio.

Another significant feature of the present invention, is the sharpness of the crease. A rounded, corrugated type apex produces a product which lacks the geometrical requirements of the present invention. A rounded apex will cause the product to collapse under load due to the curving of the paper. By way of contrast, a true pleat, that is, one with a sharp crease, transmits forces from the apex, along the paper, to the base. A curved apex, that is, a non-creased product curves or rolls under load and cannot transmits the load from the apex to the base. Thus, the term pleat, as employed herein, refers to a sheet material produced by creasing the fibers at the apex of the fold, as distinguished from a product which merely folds the sheet material and is not creased at the apex.

To produce a pleat three methods are available in the industry. The first method involves a paddle wheel that works against a smooth metal anvil (a steel roller making contact with the paddle wheel). The paddles are spaced according to the pleat designed required. The paddle works not only as a creasing mechanism, but, also pushes the creases together to create pleating since it revolves somewhat faster than the anvil—skidding the paper together into pleats. The second manufacturing process involves two overlapping plates which move up and down. As the upward plate slides downward just in front of the upward plate it draws paper into a position to be pleated. The bottom plate then pushes against the upward plate and forms a crease. The plates then separate and overlap in reverse allowing the bottom plate to draw the paper inward—and the procedure is continued. Both of the above methods run slowly, although, the rotary paddle design is much faster it provides friction against the paper which can tear it at high speeds. The third method, which is used for this product is also a rotary Pleater utilizing two matched gears. The rotary pleat tool resemblance to gears has vitally important differences to manufacture pleated paper correctly.

The pleat tool is made up of teeth which fit in-between the teeth of the opposing pleat tool. The top of the tooth is called the crest. The very bottom of the valley created between two teeth is called the root. Unlike typical matched gear designs, though, it is critically important that the crest is able to touch the root for a definitive and absolute creasing of the paper at each pleat angle. To accomplish this the root is manufactured smaller in width than the root. Since both tools have the same inclined angle there will naturally be a space between the teeth even though there is contact with the crest and the root. This side space that inhibits the inclined angles from touching each other allows for the crest and the root guaranteed contact without interference from the sides of the teeth. If the teeth sides touched then additional force would be needed to make a permanent crease on the paper which would increase manufacturing costs. The optimum pressure creates fiber compression without tearing, maintaining the pleat angle strength but limiting the relaxing that occurs if the pleat angle is not creased with enough force.

In order to accommodate the relaxation that occurs the tooth is manufactured typically 5 to 10 degrees steeper than the actual manufactured product desired. As an example, a desired 60 degree angle would be initially manufactured at 70 degrees to allow for the paper to relax to 60 degrees. The amount of relaxation varies as different papers are used, i.e, recycled, virgin, or a combination of both. It is not critical though, to vary the pleat tool angle for each type of paper. The worst case of relaxation need to be taken into account and if the paper does not relax to the desired angle all that is needed is to slow the pleating manufacturing process as compared to the gluing process (found just downstream from the pleater). This slowing will force the pleats to open, thereby decreasing the angle of the pleat to the desired angle.

Therefore, to optimize the 3/16 inch product, the pleat tools is manufactured with matched pleat angles of 60 to 85 degress, with a preferred range of about 65 to 79 degrees for a desired 60 degree angle. The root is in the range from about 0.015 to 0.035 inches wide with a preferred root range of about 0.015 to 0.025 inches. The greater the dimension differential between the root and crest, the easirer it is to mate the two gears.

The crest, in order to sharply crease the paper, is in the most preferred range from about 0.004 to 0.01, depending upon the paper thickness being creased, with an optimum range of about 0.004 to 0.006 inches. The lower limit of the crest dimension is guided by the ability to sharp the tool. The upper limit is determined by the desire to avoid a substantial truncation of the apices. The truncation, or flat upper surface provides a good surface for the application of adhesive and bond of the pleated sheet to the planar sheet, but also serves to decrease the number of pleats per inch.

Many gear type pleating operations utilize a simple approach to turning the pleats. Since they are already the shape of a gear both gears can easily turn if only one is powered. To pleated product for packaging, however, the approach needs to be more exact since it is important to be able to crease consistently utilizing the root and the crest. To do this the gears are powered to turn independently of one another. In this way the top gear tooth crest will strike the center of the root yielding enough space for the paper to remain loose between the teeth and only creased at the point of impact. This method also assures that the full depth of the tool is utilized. If the tools were not timed properly the crest could hit the sidewall and inhibit the full length of the pleat from being obtained.

In looking at the gear teeth, it is seen that the crest of one tooth must be dimensioned to nest against the root of the other gear to the extent that paper is crushed between the mating root and crest. The space between each of the two sidewalls of the pair of teeth which form a root area and the enclosed tooth which provides the compression crest mating is most advantageously, at least equal to about the thickness of the paper being crushed. It is noted that the position between the two mating gears varies with time, and the aforenoted spacing is at the point in time of crushing the paper. By this mechanism, the force is applied at the point of crushing and is not distributed along the walls of the pleat. This dramatically minimizes the amount of force which is necessary to achieve the desired result.

Once the pleating is accomplished the pleated paper travels to the combining process where the tissue layers are spray glued with pressure sensative adhesive and then rolled against the pleating to adhere the tissue layers to the pleating. Belts are placed around the rollers so that a continous pressure can be placed on the tiisue and pleating to assure adhesion.

What is claimed is:

1. The method of packaging a product for shipping within a protective cushion wrap, comprising the steps of;

unrolling sheet material from a continuous roll, said roll of sheet material having an axis and said direction of unrolling being transverse to said axis, forming a series of pleats in said sheet material, said pleats having their apices parallel to said axis, bringing at least one sheet of a planar tissue paper material from a continuous roll, into contact with at least one surface of said pleated sheet material, adhering said pleated sheet material to said sheet from said continuous roll, to form the combination of a sheet of pleated material and a cover sheet layer, severing a length of said combination of pleated material and a cover sheet layer, to form a packaging wrap material, completely enclosing a product within said packaging wrap material, with at least two end regions overlapping each other to form a region having at least two layers of packaging wrap material, and conforming said packaging wrap material to the shape of said product.

2. The method of claim 1, wherein said pleated sheet material is kraft paper, and is pleated by crushing fibers at the apices of the pleats.

3. The method of claim 2, where said apices of said severed lengths have a length of at least 6 inches.

4. The method of claim 2, wherein said apices of said severed length have a length of at least 12 inches.

5. The method of claim 1, wherein said planar sheet has a weight in the range from about 10 to about 20 pounds.

6. The method of producing a packaging material for use in shipping a product within a protective cushion wrap, comprising the steps of;

unrolling sheet material from a continuous roll, said roll of sheet material having an axis and said direction of unrolling being transverse to said axis, forming a series of pleats in said sheet material, said pleats having their apices parallel to said axis, bringing at least one sheet of a planar material from a continuous roll, into contact with at least one surface of said pleated sheet material, said planar sheet material being tissue paper, adhering said pleated sheet material to said sheet from said continuous roll, to form the combination of a sheet of pleated material and a cover sheet layer, and severing a length of said combination of pleated material and a cover sheet layer, to form a packaging wrap material.

7. The method of claim 6, wherein said pleated sheet material has a pleat angle in the range from above 45 degrees to below 85 degrees and said sheet material being kraft paper having a weight in the range from about 30 to 50 pounds, and said planar sheet material is tissue paper having a weight of in the range from about 10 to about 20 pounds.

8. The method of claim 7, wherein the pleats have an angle of about 50 to 65 degrees.

9. The method of claim 7, wherein said pleats have a height in the range from about 3 sixteenths of an inch to about one half inch.

10. The method of claim 6, further comprising the step of completely enclosing a product within said packaging wrap material, with at least two end regions overlapping each other to form a region having at least two layers of packaging wrap material, and conforming said packaging wrap material to the shape of said product.

11. The method of claim 6, wherein said pleated sheet material is kraft paper, and is pleated by crushing fibers at the apices of the pleats.

12. The method of packaging a product for shipping within a protective cushion wrap, comprising the steps of;

unrolling kraft sheet material from a continuous roll, said roll of sheet material having an axis and said direction of unrolling being transverse to said axis, forming a series of creased pleats in said sheet material by crushing fibers at the apices of the pleats, said pleats having their apices parallel to said axis, bringing at least one sheet of a planar tissue paper material from a continuous roll, into contact with at least one surface of said pleated sheet material, adhering said pleated sheet material to said sheet from said continuous roll, to form the combination of a sheet of pleated material and a cover sheet layer, severing a length of said combination of pleated material and a cover sheet layer, to form a packaging wrap material that can be molded to the contours of a contained product, completely enclosing a product within said packaging wrap material, with at least two end regions overlapping each other to form a region having at least two layers of packaging wrap material.

13. The method of claim 12, further comprising the step of conforming said packaging wrap material to contours of said product.

14. The method of claim 12, wherein said pleated sheet material has a pleat angle in the range from above 45 degrees to below 85 degrees and said sheet material being kraft paper having a weight in the range from about 30 to 50 pounds, and said planar sheet material is tissue paper having a weight of in the range from about 10 to about 20 pounds.

15. The method of claim 14, wherein said pleats have a height in the range from about 3 sixteenths of an inch to about one half inch.

* * * * *